US005903591A

United States Patent [19]

Brassey

[11] Patent Number: 5,903,591

[45] Date of Patent: May 11, 1999

[54] APPARATUS AND PROCESS FOR ACTIVATION OF CARBONACEOUS CHAR OR REACTIVATION OF SPENT CARBON BY ELECTRICAL RESISTANCE HEATING

[76] Inventor: John Michael Brassey, 2 Timber Lake Rd. North, Sherman, Conn. 06784

[21] Appl. No.: 08/784,013

[22] Filed: Jan. 15, 1997

[51] Int. Cl.[6] ..... H05B 3/60

[52] U.S. Cl. ..... 373/120; 373/111; 373/115

[58] Field of Search ..... 373/58, 115–120, 373/166; 502/5, 55, 432; 201/19, 27, 99; 432/129

[56] References Cited

U.S. PATENT DOCUMENTS 1,680,163 8/1928 Miguet ..... 373/120
5,089,457 2/1992 Gaylard et al. ..... 502/5
5,173,921 12/1992 Gaylord et al. .
5,377,220 12/1994 Plessis ..... 373/120
5,406,582 4/1995 du Plessis .

*Primary Examiner*—Tu Ba Hoang

[57] ABSTRACT

An apparatus and process for the activation or reactivation of carbon in a tubular reactor that consists of two or more sequential sections, each section containing a descending column of carbon, with the inlets to introduce steam into any one or more of the sections, wherein the the bottom of each section is provided with a hollow splitter box that is integral with the vertical reactor and and is furnished with interior pairs of alternately sloped perforated steel plates which direct the carbon in opposing patterns of descending motion to promote intermixing and homogenization.

7 Claims, 2 Drawing Sheets

APPARATUS AND PROCESS FOR ACTIVATION OF CARBONACEOUS CHAR OR REACTIVATION OF SPENT CARBON BY ELECTRICAL RESISTANCE HEATING

FIELD OF THE INVENTION

This invention relates to an improved apparatus and process for the activation of carbonaceous feedstocks or the reactivation of spent activated carbon (both hereinafter referred to as the "carbon" or the "carbon feedstock") by electrical resistance heating in the presence of steam. It particularly relates to an improved apparatus in which the carbon is repeatedly homogenized as it progresses through the apparatus, with the result that both the electric current and the steam are more uniformly distributed through the carbon.

DESCRIPTION OF THE RELATED ART

The use of electrical resistance heating for activation and reactivation of carbon in the presence of steam has been described in U.S. Pat. No. 5,406,582 as well as in U.S. Pat. Nos. 5,089,457, and 5,173,921. In the process described in the first cited patent, the apparatus comprised a tubular reactor that consisted of two or more sequential vertical sections, each section containing a descending column of carbon, with inlets to introduce steam into any one or more of the sections, and wherein the electric current was fed into the column of carbon of each such section via a graphite block serving as an electrode and positioned at the center of the top of the column by attachment to a steel plate that included a flat or a V-shaped shelf and that was provided with openings to allow the released gases and vapors to escape.

In the activation of a carbonaceous char, the steam serves as a chemical reagent that selectively gasifies some of the carbon by converting it to carbon monoxide, and thus creates a large pore volume and extensive surface area. In reactivation of spent activated carbons, the steam serves to remove, or desorb, the matter that the carbon has retained.

Other gases can also be used in place of steam to activate carbon. An example is carbon dioxide, which can also gasify carbon by converting it to carbon monoxide.

In the process and apparatus described in U.S. Pat. No. 5,406,582 the carbon entering each section must pass around and be in reasonable proximity to the centrally positioned graphite electrode. The carbon then flows downward into the next section, the upper portion of such descending carbon forming a cone whose side forms an angle with the horizontal, the so-called "angle of repose," which is defined as the maximum slope or angle at which loose material remains stable.

In these inventions described in the prior art, the various improvements have been designed to optimize the homogeneous distribution of the electric current through the carbon and the penetration of steam or other gases through the carbon. These improvements have not, however, been directed to the homogenization of the carbon itself. Such homogenization, if attained, will necessarily also result in the improved distribution of electric current and the penetration of activating gas through the carbon.

It is accordingly an object of this invention to provide an improved apparatus for the activation of carbon feedstocks or the reactivation of spent activated carbon by electrical resistance heating in the presence of an activating gas.

It is another object of this invention to provide such improvement when the activating gas is steam or carbon dioxide.

It is yet another object of this invention to provide such improvement whereby the more complete homogenization of the carbon during the activation or reactivation process is achieved.

SUMMARY OF THE INVENTION

I have discovered an improved means for homogenization of carbon during its activation or reactivation by electrical resistance heating in the presence of an activating gas.

Briefly, the object of this invention is achieved by improvements in an apparatus and in a process that utilize a feed hopper from which the carbon feedstock or spent activated carbon enters by gravity into a vertical tubular reactor of refractory material, whose top is joined to the bottom of the feed hopper, and whose bottom is joined to a valve or other means for removal of the activated or reactivated carbon product, the reactor consisting of two or more vertical sequential sections, a descending column of carbon feedstock moving through each section, with the means to introduce steam into each of said sections, and wherein the electric current is fed into the column of descending carbon feedstock via graphite blocks serving as electrodes and suitably attached and positioned at the center of the top of each such section, each section being provided with an opening to allow the released gases and vapors to escape, an electrical terminal on the outside of the feed hopper and another terminal at the bottom of the reactor, said terminals being connected to a source of electric current, the current passing between the terminals through the descending carbon particles. The improvements in the apparatus consist in reducing the cross-sectional area near the bottom of each section while altering its circular cross-section to a rectangular one, whose length and width are each less than the diameter of the cylindrical reaction tube from which it is altered, and in providing a hollow rhombic or orthorhombic structure, hereinafter called a "splitter box," that is integral with the vertical reactor and conforms to the aforesaid rectangular cross-section and that is furnished with interior pairs of perforated sloping crossed steel plates which direct the carbon in opposing patterns of descending motion to promote intermixing and homogenization. Steam is introduced into the hollow structure below the crossed plates and passes through their perforations into the descending carbon. This arrangement ensures the maximum steam penetration into the descending carbon and, consequently, the optimum steam-to-carbon contact. Such improved contact, in turn, promotes and accelerates the reaction between the steam and the carbon. The form of one such arrangement is shown in FIG. 2 described below.

The homogenized carbon that descends from the splitter box enters the reactor section immediately below, where its conical upper boundary assumes the angle of repose that is characteristic of its particle size and physical properties. A graphite electrode is positioned below the splitter box so that it is in contact with the carbon near the upper end of the cone to continue to promote the uniform distribution of electric current within the carbon.

A major advantage of the apparatus and process of my invention is the greatly improved uniformity of contact between the carbon and the activating gas (such as steam). As the gas passes through the splitter box, it meets a uniform mixture of descending carbon particles, and therefore the efficiency and speed of the activation or reactivation are greatly enhanced.

DESCRIPTION OF THE PREFERRED EMBODIMENTS

In the preferred embodiments, the carbon feedstock is fed sequentially into two to four reaction sections, as will be made clearer by reference to the accompanying drawings in FIG. 1, which is a partly diagrammatic and partly vertical section of the apparatus, and FIG. 2, which is a perspective view of part of the apparatus.

Figure 1:
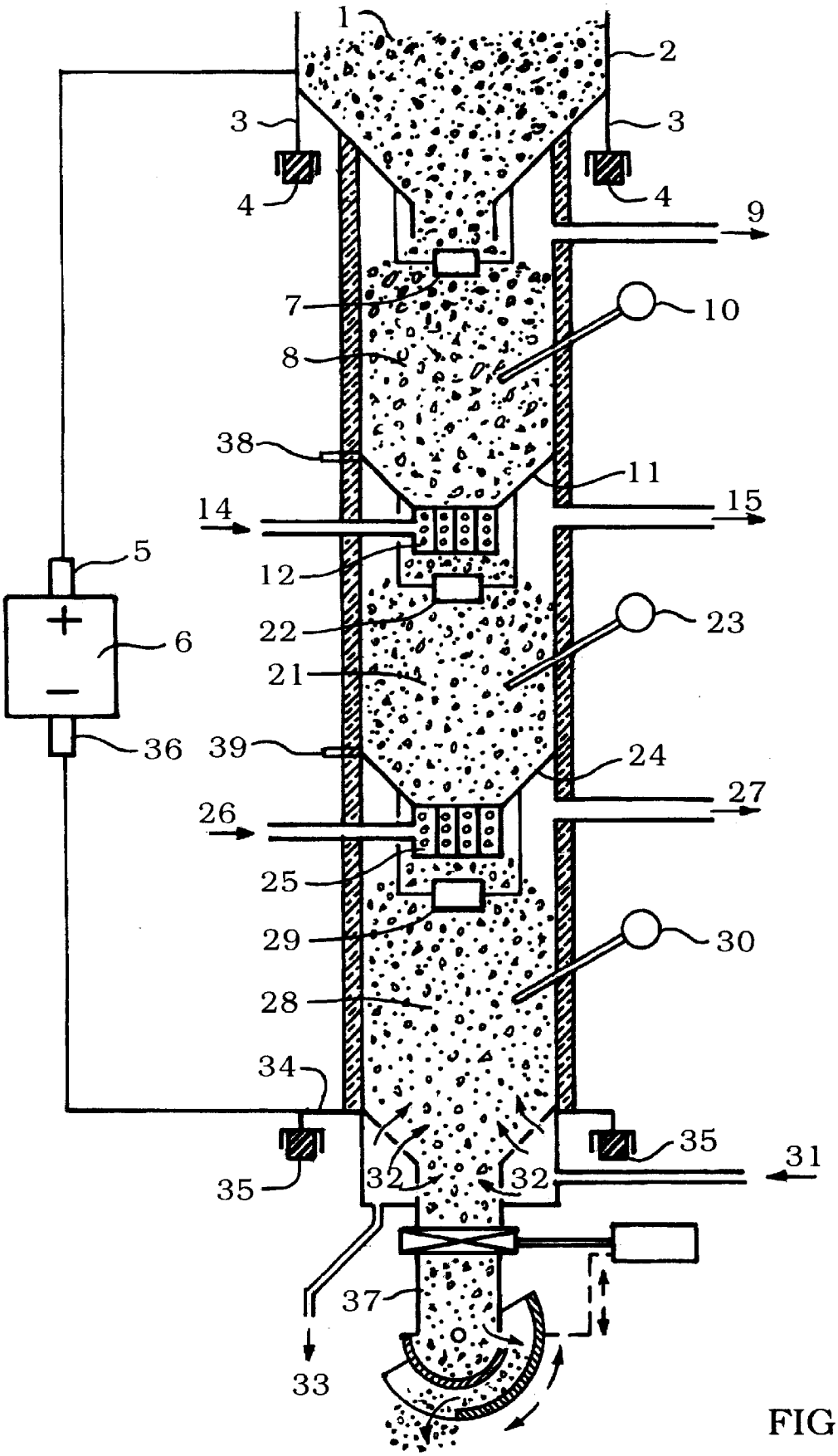
FIG. 1 shows an apparatus for use in the drying and activation or reactivation of carbon by electrical resistance heating according to the process of the present invention.
Figure 2:
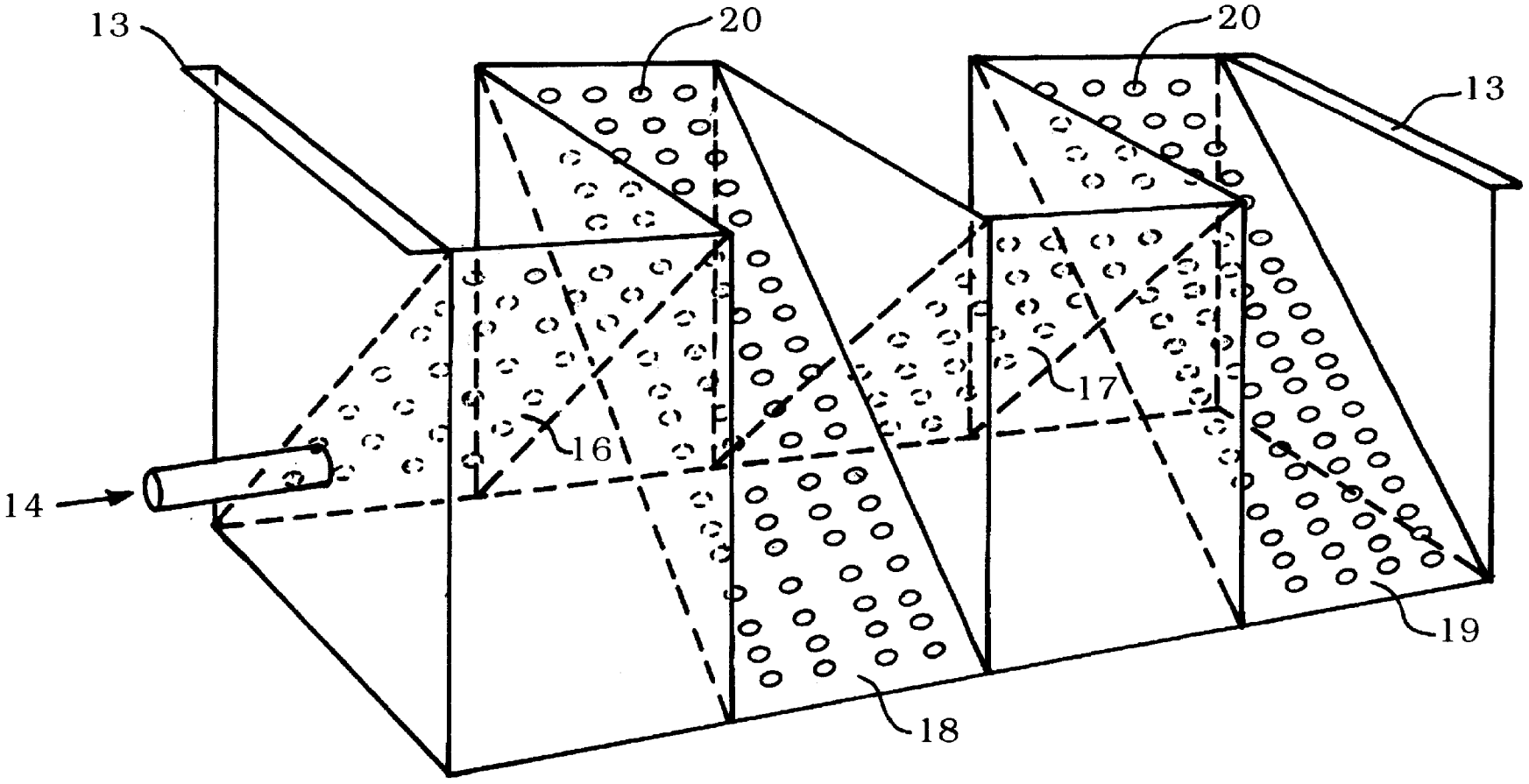
FIG. 2 shows a detail in perspective of one of the splitter boxes that are positioned at the top of each section except for the uppermost section 1.

In FIG. 1, the carbon is fed sequentially into three sections. If the carbon is wet, the top section is a drying section. The other two are steam-injection sections. The carbon 1 is loaded into a steel feed hopper 2, which is electrically isolated from its supports 3 by insulators 4. The feed hopper is attached to electrical terminal 5 which is fed by a DC or AC power supply 6. The carbon moves by gravity around and past graphite block 7 into the first section 8. The emitted steam and other gases escape through opening 9. The temperature of the carbon in section 8 is measured by thermocouple 10. The shape of the lower portion 11 of section 8 is modified by changing its circular cross-section to a rectangular cross-section, and its cross-sectional area is reduced so that it leads into and conforms with splitter box 12, which is shown in perspective in FIG. 2. Splitter box 12 can be made removable by providing it with projecting rims 13 that can allow it to be suspended on corresponding projections at the lower end of portion 11. Splitter box 12 is provided with a steam inlet 14. Exhaust gases escape through outlet 15. Splitter box 12 is provided with two sets of sloped plates, one set of which, plates 16 and 17, is sloped in one direction while the other set, 18 and 19, is oppositely sloped. The sloped plates are provided with perforations 20 to provide passsage for the steam. The descending carbon is thus split into two separated streams, which then recombine as they enter the second section 21. Graphite electrode 22 is positioned within the descending carbon below splitter box 12 and in the upper portion of section 21. Section 21 is also provided with thermocouple 23. The transition below section 21 follows the same pattern as the transition below section 8; that is, its lower portion 24 is reduced and modified to conform to splitter box 25, which is provided with steam inlet 26 and gas exhaust 27. The descending carbon streams again recombine as they enter the third section 28, which is provided with graphite electrode 29 and thermocouple 30. Steam is introduced into section 28 through inlets 31 and 32, and steam condensate is drained through tube 33. The bottom support 34 of the apparatus, which is electrically isolated by insulators 35, is connected to the other terminal 36 of the electrical power supply. The discharge of the apparatus is controlled by discharge system 37 and fed into any suitable receiving container, such as a steel drum.

It is evident to anyone skilled in the art that various modifications of the apparatus can be made to satisfy various reaction conditions, feedstocks, and desired properties of the activated or reactivated carbon, without changing the basic nature or inventiveness of my disclosure. For example, the number of sections can be reduced to two, or increased to four or more. The energy inputs can be made more selective by supplying electric current only to a limited number of sections rather than to all by the use of suitable isolation transformers. Electrical inputs can be furnished individually to each section by terminals 38 and 39. Steam inputs can also be adjusted individually to conform to the moisture contents of the various carbon feedstocks.

My invention will be made clearer by the following examples. These examples are given for illustration only, and are not considered to be limiting.

EXAMPLE 1

A charge of coconut shell char, which constitutes a feedstock for the production of activated carbon, was introduced into the feed hopper 2 of the apparatus shown in FIG. 1. The diameter of the reaction tube was 27 inches, the height of each section (excluding the splitter box) was 30 inches, and the splitter box was 9 inches wide, four inches deep and four inches high. The temperature in each of the three reaction sections 8, 21, and 28 shown in the drawing of FIG. 1 was kept at 900 to 1000° C., and steam was injected into inlets 13, 26, and 31 at a total rate of about 50 kg/hour. Current was maintained between 100 and 150 amperes, which required between 150 and 450 volts. When the carbon was removed from the apparatus through discharge system 34 at a rate of 50 kg of product per hour, I found that the Iodine Number (A.S.T.M. Standard Test Method D 4607) of various samples ranged from 950 to 1000, and that the Carbon Tetrachloride Activity (A.S.T.M. Standard Test Method D 3467) ranged from 60 to 63. These values are characteristic of an activated carbon that is suitable for a wide diversity of commercial applications. Also, the narrow range in properties of separate samples indicates that a good homogeneity of the carbon was achieved by the apparatus and process of my invention.

EXAMPLE 2

A charge of a petroleum coke activated carbon that had been exhausted (saturated) by exposure to commercial kitchen exhaust vapors was introduced into the feed hopper 2, shown in FIG. 1. The temperature in each of the three reaction sections 8, 21, and 28 shown in the drawing was kept at 900 to 1000° C., and steam was injected into inlets 13, 26, and 31 at a total rate of 50 kg/hour. Current was maintained between 80 and 100 amperes, which required between 150 and 450 volts. As the carbon was discharged from the apparatus at a rate of 200 kg of product per hour, I found that the Iodine Number (A.S.T.M. Standard Test Method D 4607) ranged from 1000 to 1050, and that the Carbon Tetrachloride Activity (A.S.T.M. Standard Test Method D 3467) ranged from 60 to 65. These values are characteristic of a homogeneous and highly activated carbon, suitable for a wide diversity of commercial applications.

EXAMPLE 3

A charge of a coal-based activated carbon that had been exhausted (saturated) by exposure to a stream of water contaminated with gasoline was introduced into the feed hopper 2. The temperature in each of the three reaction sections 8, 21, and 28 shown in the drawing was kept at 850 to 1000° C., and steam was injected into inlets 13, 26, and 31 at a total rate of 50 kg/hour. Current was maintained between 100 and 150 amperes, which required between 150 and 450 volts. As the carbon discharged from the apparatus at a rate of 50 kg of product per hour, I found that the Iodine Number (A.S.T.M. Standard Test Method D 4607) ranged from 900 to 950, and that the Carbon Tetrachloride Activity (A.S.T.M. Standard Test Method D 3467) ranged from 58 to 60. These values are characteristic of a homogeneous and suitably activated carbon, suitable for a wide diversity of commercial applications.

I claim:

1. In an apparatus for the activation of a carbon feedstock or the reactivation of a spent carbon feedstock by electrical resistance heating in the presence of steam, that comprises a feed hopper from which the carbon feedstock enters by gravity into a tubular reactor having a circular cross-section of refractory material to form a descending column of carbon feedstock, wherein the top of the reactor is joined to the bottom of the feed hopper, and wherein the bottom of the reactor is joined to a valve for removal of the activated or reactivated carbon product, an electrical terminal on the outside of the feed hopper and another terminal affixed at the bottom of the reactor, said terminals being connected to a source of electric current, the current passing between the terminals through the descending carbon feedstock, the reactor consisting of at least two sequential vertical sections, each section containing a moving column of carbon feedstock and a graphite block serving as an electrode, with inlets to introduce steam into any of said sections in sequence, the improvement wherein the circular cross-section at the bottom of each section is reduced and is altered into a rectangular one, whose length and width are each less than the diameter of the circular cross section from which it is altered, and to which a rectangular cross-section splitter box is integral and conforms to the aforesaid rectangular cross-section and said splitter box is furnished with interior pairs of alternately sloped perforated steel plates which direct the carbon in opposing patterns of descending motion.

2. An apparatus according to claim 8 in which the splitter box is rhombic.

3. An apparatus according to claim 8 in which the splitter box is orthorhombic.

4. An apparatus according to claim 8 in which the splitter box is provided with an inlet for steam injection into the hollow structure below the crossed plates.

5. An apparatus according to claim 8 wherein the number of sections is at least 3.

6. An apparatus according to claim 8 wherein the splitter box has at least one set of oppositely sloped perforated plates.

7. An apparatus according to claim 8 wherein the graphite electrode is absent from one or more sections.

* * * * *